US009046832B2

(12) United States Patent
Samei et al.

(10) Patent No.: US 9,046,832 B2
(45) Date of Patent: Jun. 2, 2015

(54) FIXING DEVICE HAVING HEAT SHIELDING DEVICE AND IMAGE FORMING APPARATUS INCORPORATING SAME

(71) Applicants: Masahiro Samei, Kanagawa (JP); Hiroshi Seo, Kanagawa (JP); Ryota Yamashina, Kanagawa (JP)

(72) Inventors: Masahiro Samei, Kanagawa (JP); Hiroshi Seo, Kanagawa (JP); Ryota Yamashina, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 139 days.

(21) Appl. No.: 13/864,320

(22) Filed: Apr. 17, 2013

(65) Prior Publication Data

US 2013/0308990 A1 Nov. 21, 2013

(30) Foreign Application Priority Data

May 18, 2012 (JP) ..... 2012-114573

(51) Int. Cl.
*G03G 15/20* (2006.01)

(52) U.S. Cl.
CPC ..... *G03G 15/2007* (2013.01); *G03G 15/2064* (2013.01); *G03G 15/2053* (2013.01); *G03G 2215/2035* (2013.01)

(58) Field of Classification Search
CPC ..... G03G 15/2007; G03G 15/2053; G03G 15/2064; G03G 2215/2035
USPC ..... 219/216; 399/328, 329, 336; 432/60
See application file for complete search history.

(56) References Cited

U.S. PATENT DOCUMENTS

| | | | | |
|---|---|---|---|---|
| 8,010,028 | B2 * | 8/2011 | Shinshi | 399/329 |
| 8,116,670 | B2 * | 2/2012 | Shinshi | 399/329 |
| 8,150,305 | B2 * | 4/2012 | Shin | 399/329 |
| 8,588,670 | B2 * | 11/2013 | Shimokawa et al. | 399/329 |
| 8,639,169 | B2 * | 1/2014 | Cao et al. | 399/329 |
| 8,737,893 | B2 * | 5/2014 | Fujiwara et al. | 399/329 |
| 2007/0003334 | A1 | 1/2007 | Shinshi et al. | |
| 2007/0059003 | A1 | 3/2007 | Shinshi et al. | |
| 2007/0059011 | A1 | 3/2007 | Seo et al. | |
| 2007/0212089 | A1 | 9/2007 | Seo et al. | |
| 2007/0242988 | A1 | 10/2007 | Seo et al. | |
| 2007/0280754 | A1 | 12/2007 | Ogawa et al. | |
| 2007/0292175 | A1 | 12/2007 | Shinshi | |
| 2008/0025772 | A1 | 1/2008 | Seo et al. | |
| 2008/0025773 | A1 | 1/2008 | Ito et al. | |
| 2008/0044196 | A1 | 2/2008 | Seo et al. | |
| 2008/0219721 | A1 | 9/2008 | Ito et al. | |

(Continued)

FOREIGN PATENT DOCUMENTS

| | | |
|---|---|---|
| JP | 2003-107948 | 4/2003 |
| JP | 2004-170692 | 6/2004 |

(Continued)

*Primary Examiner* — William J Royer
(74) *Attorney, Agent, or Firm* — Harness, Dickey & Pierce, P.L.C.

(57) ABSTRACT

A fixing device includes an endless belt formed into a loop and rotatable in a given direction of rotation. An opposed rotary body contacts the endless belt to form a fixing nip therebetween through which a recording medium bearing a toner image is conveyed. A heater is disposed in proximity to an irradiation span spanning on an inner circumferential surface of the endless belt in a circumferential direction thereof to emit light that irradiates and heats the irradiation span of the endless belt. A shield is interposed between the heater and the irradiation span of the endless belt in a diametrical direction thereof to shield the irradiation span of the endless belt from heated air surrounding the heater.

19 Claims, 8 Drawing Sheets

(56) References Cited

U.S. PATENT DOCUMENTS

| | | | |
|---|---|---|---|
| 2008/0226326 | A1 | 9/2008 | Seo et al. |
| 2008/0232873 | A1 | 9/2008 | Ueno et al. |
| 2009/0060550 | A1 | 3/2009 | Seo |
| 2009/0148205 | A1 | 6/2009 | Seo et al. |
| 2009/0245897 | A1 | 10/2009 | Seo et al. |
| 2009/0297199 | A1 | 12/2009 | Yamashina et al. |
| 2010/0061754 | A1 | 3/2010 | Ishigaya et al. |
| 2010/0092220 | A1 | 4/2010 | Hasegawa et al. |
| 2010/0092221 | A1 | 4/2010 | Shinshi et al. |
| 2010/0303521 | A1 | 12/2010 | Ogawa et al. |
| 2011/0052224 | A1 | 3/2011 | Yamashina et al. |
| 2011/0052277 | A1 | 3/2011 | Ueno et al. |
| 2011/0064437 | A1 | 3/2011 | Yamashina et al. |
| 2011/0064450 | A1 | 3/2011 | Ishii et al. |
| 2011/0064490 | A1 | 3/2011 | Imada et al. |
| 2011/0064502 | A1 | 3/2011 | Hase et al. |
| 2011/0091226 | A1 | 4/2011 | Ishigaya et al. |
| 2011/0091253 | A1 | 4/2011 | Seo et al. |
| 2011/0150518 | A1 | 6/2011 | Hase et al. |
| 2011/0182634 | A1 | 7/2011 | Ishigaya et al. |
| 2011/0206402 | A1 | 8/2011 | Yamashina |
| 2011/0217057 | A1 | 9/2011 | Yoshinaga et al. |
| 2011/0222876 | A1 | 9/2011 | Yuasa et al. |
| 2011/0222926 | A1 | 9/2011 | Ueno et al. |
| 2011/0222927 | A1 | 9/2011 | Yamashina |
| 2011/0229161 | A1 | 9/2011 | Ueno et al. |
| 2011/0229162 | A1 | 9/2011 | Ogawa et al. |
| 2011/0229178 | A1 | 9/2011 | Ogawa et al. |
| 2011/0229236 | A1 | 9/2011 | Ehara et al. |
| 2011/0299899 | A1 | 12/2011 | Ishigaya et al. |
| 2011/0311284 | A1 | 12/2011 | Seo et al. |
| 2012/0093532 | A1 | 4/2012 | Ishigaya et al. |
| 2012/0093534 | A1 | 4/2012 | Waida et al. |
| 2012/0148287 | A1 | 6/2012 | Samei et al. |
| 2012/0148317 | A1 | 6/2012 | Samei et al. |
| 2012/0201547 | A1 | 8/2012 | Yamashina |
| 2012/0207502 | A1 | 8/2012 | Seo |
| 2012/0219312 | A1 | 8/2012 | Yuasa et al. |
| 2012/0243895 | A1 | 9/2012 | Samei et al. |
| 2013/0051876 | A1 | 2/2013 | Ishigaya et al. |

FOREIGN PATENT DOCUMENTS

| | | |
|---|---|---|
| JP | 2005-156891 | 6/2005 |
| JP | 2007-233011 | 9/2007 |
| JP | 2007-334205 | 12/2007 |
| JP | 2008-064930 | 3/2008 |

* cited by examiner

FIXING DEVICE HAVING HEAT SHIELDING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-114573, filed on May 18, 2012, in the Japanese Patent Office, the entire disclosure of which is hereby incorporated by reference herein.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a first print time taken to output the recording medium bearing the fixed toner image onto the outside of the image forming apparatus after the image forming apparatus receives a print job. Additionally, the fixing device is requested to generate a sufficient amount of heat even when a plurality of recording media is conveyed through the fixing device continuously at increased speed for high speed printing.

To address these requests, the fixing device may employ a thin endless fixing belt having a decreased thermal capacity that decreases an amount of heat required to heat the fixing belt to a given fixing temperature at which the toner image is fixed on the recording medium. FIG. 1 illustrates such fixing device 20R1 that incorporates a thin endless fixing belt 100. For example, as shown in FIG. 1, a pressing roller 400 is pressed against a substantially tubular, metal thermal conductor 200 disposed inside a loop formed by the fixing belt 100 to form a fixing nip N between the pressing roller 400 and the fixing belt 100. A heater 300 disposed inside the metal thermal conductor 200 heats the fixing belt 100 via the metal thermal conductor 200. As the pressing roller 400 and the fixing belt 100 rotate and convey a recording medium P bearing a toner image T through the fixing nip N in a recording medium conveyance direction A1, the fixing belt 100 and the pressing roller 400 apply heat and pressure to the recording medium P, thus fixing the toner image T on the recording medium P. Since the heater 300 heats the fixing belt 100 via the metal thermal conductor 200 that faces the entire inner circumferential surface of the fixing belt 100, the fixing belt 100 is heated to a given fixing temperature quickly, thus meeting the above-described requests of shortening the first print time and generating heat sufficiently.

However, in order to shorten the first print time further and save more energy, the fixing device is requested to heat the fixing belt 100 more efficiently. To address this request, a configuration to heat the fixing belt 100 directly, not via the metal thermal conductor 200, is proposed as shown in FIG. 2.

FIG. 2 illustrates a fixing device 20R2 in which the heater 300 heats the fixing belt 100 directly. Instead of the metal thermal conductor 200 depicted in FIG. 1, a nip formation plate 500 is disposed inside the loop formed by the fixing belt 100 and presses against the pressing roller 400 via the fixing belt 100 to form the fixing nip N between the fixing belt 100 and the pressing roller 400. Since the nip formation plate 500 does not encircle the heater 300 unlike the metal thermal conductor 200 depicted in FIG. 1, the heater 300 heats the fixing belt 100 directly, thus improving heating efficiency for heating the fixing belt 100 and thereby shortening the first print time further and saving more energy.

However, since the fixing belt 100 is heated by the heater 300 directly, the fixing belt 100 is subject to overheating that may result in deformation of the fixing belt 100 by thermal stress induced therein. For example, when the fixing belt 100 interrupts its rotation immediately after a print job is finished, residual heat remaining in the heater 300 is conducted to the fixing belt 100, thus heating a part of the fixing belt 100 disposed opposite the heater 300 directly. Accordingly, that part of the fixing belt 100 may overheat and deform. Consequently, the deformed fixing belt 100 may not apply heat and pressure to the recording medium P conveyed through the fixing nip N properly, resulting in faulty fixing.

SUMMARY OF THE INVENTION

At least one embodiment may provide a fixing device that includes an endless belt formed into a loop and rotatable in a given direction of rotation. An opposed rotary body contacts the endless belt to form a fixing nip therebetween through which a recording medium bearing a toner image is conveyed. A heater is disposed in proximity to an irradiation span spanning on an inner circumferential surface of the endless belt in a circumferential direction thereof to emit light that irradiates and heats the irradiation span of the endless belt. A shield is interposed between the heater and the irradiation span of the endless belt in a diametrical direction thereof to shield the irradiation span of the endless belt from heated air surrounding the heater.

At least one embodiment may provide a fixing device that includes an endless belt formed into a loop and rotatable in a given direction of rotation. An opposed rotary body contacts the endless belt to form a fixing nip therebetween through which a recording medium bearing a toner image is conveyed. A heater is disposed in proximity to an irradiation span spanning on an inner circumferential surface of the endless belt in a circumferential direction thereof to emit light that irradiates and heats the irradiation span of the endless belt. The heater includes a luminous tube made of a luminous transmittance material and a plurality of filaments situated inside the luminous tube to emit the light.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE SEVERAL VIEWS OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
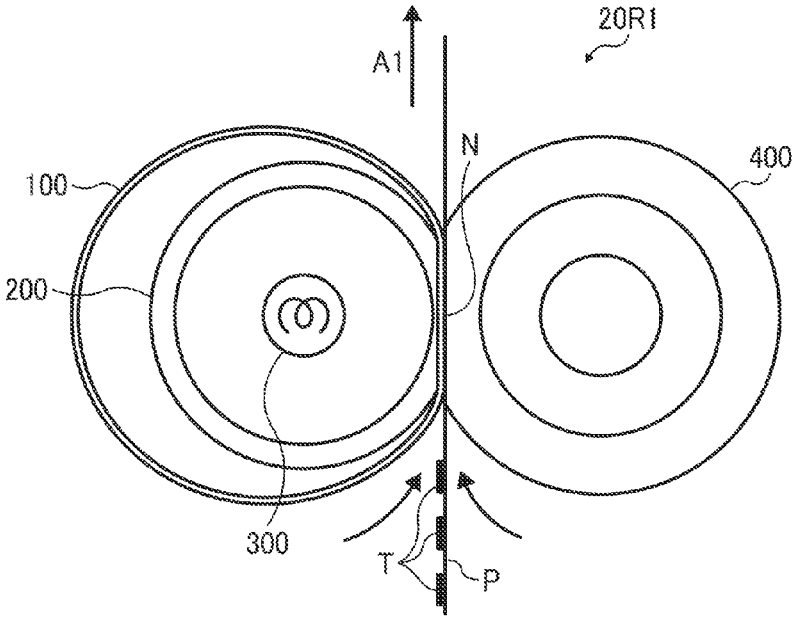
FIG. 1 RELATED ART
FIG. 1 is a schematic vertical sectional view of a related-art fixing device.
Figure 2:
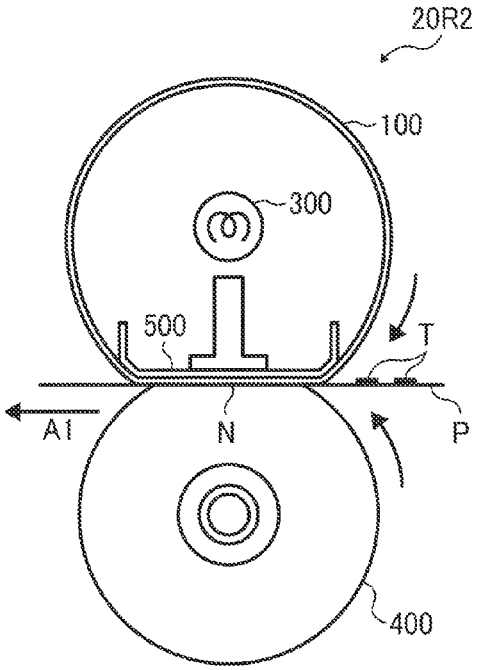
FIG. 2 RELATED ART
FIG. 2 is a schematic vertical sectional view of another related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, and the like may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
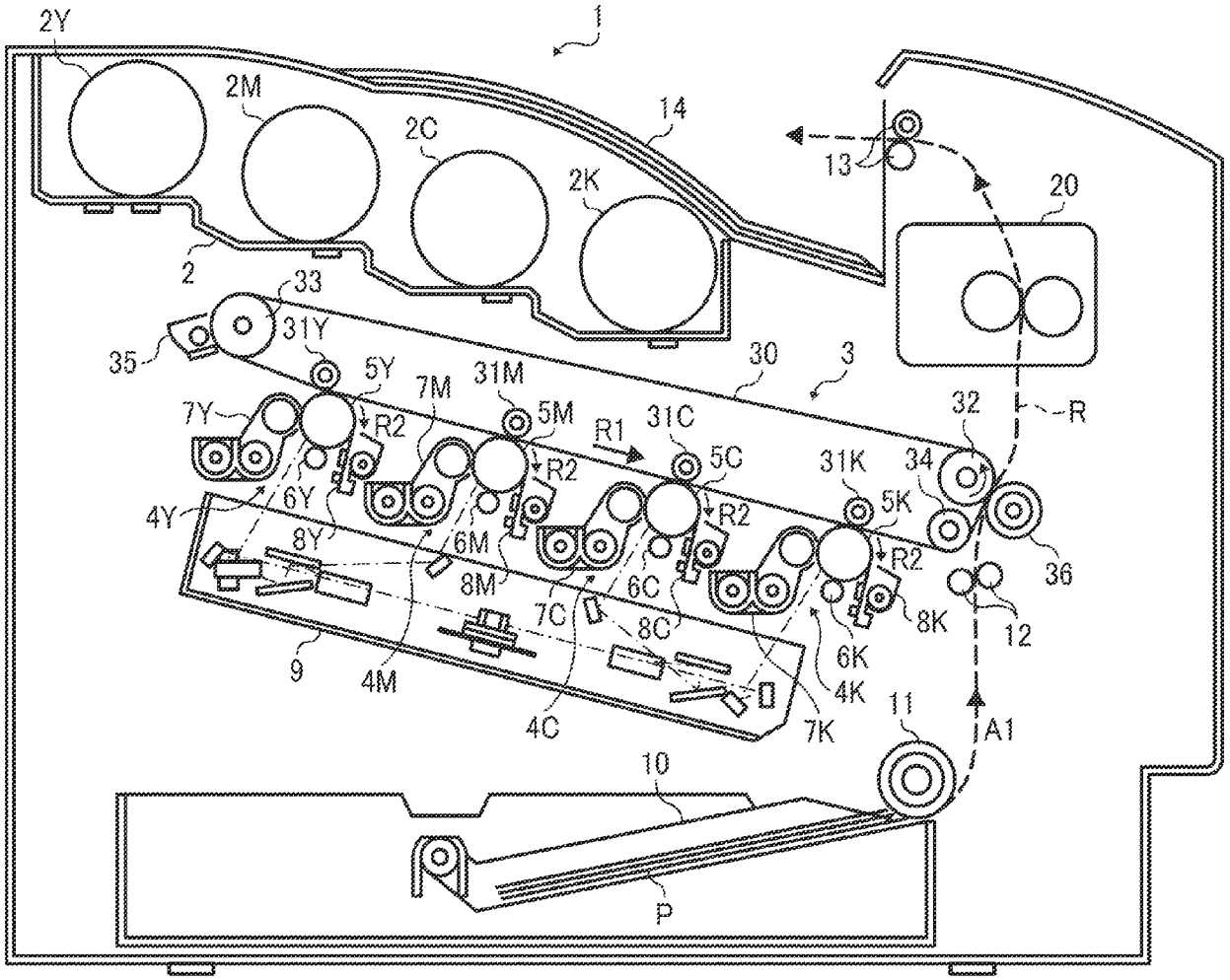
FIG. 3 is a schematic vertical sectional view of an image forming apparatus according to an example embodiment of the present invention.

Referring now to the drawings, wherein like reference numerals designate identical or corresponding parts throughout the several views, particularly to FIG. 3, an image forming apparatus 1 according to an example embodiment is explained.

FIG. 3 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this example embodiment, the image forming apparatus 1 is a color laser printer that forms color and monochrome toner images on recording media by electrophotography.

As shown in FIG. 3, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, the image forming devices 4Y, 4M, 4C, and 4K include drum-shaped photoconductors 5Y, 5M, 5C, and 5K each of which serves as an image carrier that carries an electrostatic latent image and a resultant toner image; chargers 6Y, 6M, 6C, and 6K that charge an outer circumferential surface of the respective photoconductors 5Y, 5M, 5C, and 5K; development devices 7Y, 7M, 7C, and 7K that supply yellow, magenta, cyan, and black toners to the electrostatic latent images formed on the outer circumferential surface of the respective photoconductors 5Y, 5M, 5C, and 5K, thus visualizing the electrostatic latent images into yellow, magenta, cyan, and black toner images with the yellow, magenta, cyan, and black toners, respectively; and cleaners 8Y, 8M, 8C, and 8K that clean the outer circumferential surface of the respective photoconductors 5Y, 5M, 5C, and 5K.

Below the image forming devices 4Y, 4M, 4C, and 4K is an exposure device 9 that exposes the outer circumferential surface of the respective photoconductors 5Y, 5M, 5C, and 5K with laser beams. For example, the exposure device 9, constructed of a light source, a polygon mirror, an f-θ lens, reflection mirrors, and the like, emits a laser beam onto the outer circumferential surface of the respective photoconductors 5Y, 5M, 5C, and 5K according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31Y, 31M, 31C, and 31K serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched across the secondary transfer backup roller 32, the cleaning backup roller 33, and the tension roller 34. As a driver drives and rotates the secondary transfer backup roller 32 counterclockwise in FIG. 3, the secondary transfer backup roller 32 rotates the intermediate transfer belt 30 in a rotation direction R1 by friction therebetween.

The four primary transfer rollers 31Y, 31M, 31C, and 31K sandwich the intermediate transfer belt 30 together with the four photoconductors 5Y, 5M, 5C, and 5K, respectively, forming four primary transfer nips between the intermediate transfer belt 30 and the photoconductors 5Y, 5M, 5C, and 5K. The primary transfer rollers 31Y, 31M, 31C, and 31K are connected to a power supply that applies a given direct current voltage and/or alternating current voltage thereto so that the primary transfer rollers 31Y, 31M, 31C, and 31K primarily transfer the yellow, magenta, cyan, and black toner images formed on the photoconductors 5Y, 5M, 5C, and 5K onto the intermediate transfer belt 30, thus forming a color toner image thereon.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31Y, 31M, 31C, and 31K, the secondary transfer roller 36 is connected to the power supply that applies a given direct current voltage and/or alternating current voltage thereto so that the secondary transfer roller 36 secondarily transfers the color toner image formed on the intermediate transfer belt 30 onto a recording medium P.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle container 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7Y, 7M, 7C, and 7K of the image forming devices 4Y, 4M, 4C, and 4K, respectively. For example, the fresh yellow, magenta, cyan, and black toners are supplied from the toner bottles 2Y, 2M, 2C, and 2K to the development devices 7Y, 7M, 7C, and 7K through toner supply tubes interposed between the toner bottles 2Y, 2M, 2C, and 2K and the development devices 7Y, 7M, 7C, and 7K, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, OHP (overhead projector) transparencies, OHP film sheets, and the like. The paper tray 10 loads plain paper and thick paper. Optionally, a bypass tray may be attached to the image forming apparatus 1 that loads special paper such as thick paper, postcards, envelopes, thin paper, coated paper, art paper, tracing paper, OHP transparencies, OHP film sheets, and the like as well as plain paper.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes the color toner image transferred from the intermediate transfer belt 30 onto the recording medium P. The conveyance path R is further provided with the output roller pair 13 located above the fixing device 20, that is, downstream from the fixing device 20 in the recording medium conveyance direction A1. The output roller pair 13 discharges the recording medium P bearing the fixed color toner image onto the outside of the image forming apparatus 1, that is, an output tray 14 disposed atop the image forming apparatus 1. The output tray 14 stocks the recording media P discharged by the output roller pair 13.

With reference to FIG. 3, a description is provided of an image forming operation of the image forming apparatus 1 having the structure described above to form a color toner image on a recording medium P.

As a print job starts, a driver drives and rotates the photoconductors 5Y, 5M, 5C, and 5K of the image forming devices 4Y, 4M, 4C, and 4K, respectively, clockwise in FIG. 3 in a rotation direction R2. The chargers 6Y, 6M, 6C, and 6K uniformly charge the outer circumferential surface of the respective photoconductors 5Y, 5M, 5C, and 5K at a given polarity. The exposure device 9 emits laser beams onto the charged outer circumferential surface of the respective photoconductors 5Y, 5M, 5C, and 5K according to yellow, magenta, cyan, and black image data constituting image data sent from the external device, respectively, thus forming electrostatic latent images thereon. The development devices 7Y, 7M, 7C, and 7K supply yellow, magenta, cyan, and black toners to the electrostatic latent images formed on the photoconductors 5Y, 5M, 5C, and 5K, visualizing the electrostatic latent images into yellow, magenta, cyan, and black toner images, respectively.

Simultaneously, as the print job starts, the secondary transfer backup roller 32 is driven and rotated counterclockwise in FIG. 3, rotating the intermediate transfer belt 30 in the rotation direction R1 by friction therebetween. A power supply applies a constant voltage or a constant current control voltage having a polarity opposite a polarity of the toner to the primary transfer rollers 31Y, 31M, 31C, and 31K. Thus, a transfer electric field is created at the primary transfer nips formed between the primary transfer rollers 31Y, 31M, 31C, and 31K and the photoconductors 5Y, 5M, 5C, and 5K, respectively.

When the yellow, magenta, cyan, and black toner images formed on the photoconductors 5Y, 5M, 5C, and 5K reach the primary transfer nips, respectively, in accordance with rotation of the photoconductors 5Y, 5M, 5C, and 5K, the yellow, magenta, cyan, and black toner images are primarily transferred from the photoconductors 5Y, 5M, 5C, and 5K onto the intermediate transfer belt 30 by the transfer electric field created at the primary transfer nips in such a manner that the yellow, magenta, cyan, and black toner images are superimposed successively on a same position on the intermediate transfer belt 30. Thus, a color toner image is formed on the intermediate transfer belt 30. After the primary transfer of the yellow, magenta, cyan, and black toner images from the photoconductors 5Y, 5M, 5C, and 5K onto the intermediate transfer belt 30, the cleaners 8Y, 8M, 8C, and 8K remove residual toner failed to be transferred onto the intermediate transfer belt 30 and therefore remaining on the photoconductors 5Y, 5M, 5C, and 5K therefrom. Thereafter, dischargers discharge the outer circumferential surface of the respective photoconductors 5Y, 5M, 5C, and 5K, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. The registration roller pair 12 feeds the recording medium P to the secondary transfer nip formed between the secondary transfer roller 36 and the intermediate transfer belt 30 at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

When the color toner image formed on the intermediate transfer belt 30 reaches the secondary transfer nip in accordance with rotation of the intermediate transfer belt 30, the color toner image is secondarily transferred from the intermediate transfer belt 30 onto the recording medium P by the transfer electric field created at the secondary transfer nip. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 4:
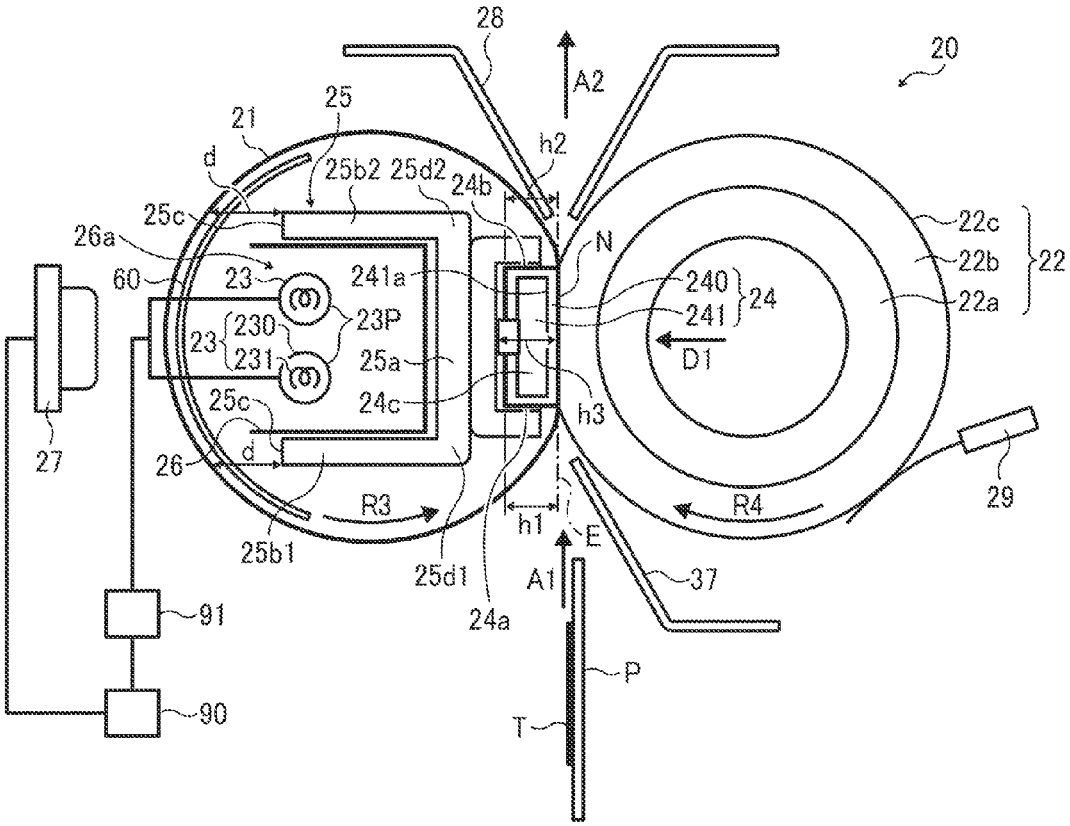
FIG. 4 is a vertical sectional view of a fixing device according to a first example embodiment of the present invention that is installed in the image forming apparatus shown in FIG. 3.

With reference to FIG. 4, a description is provided of a construction of the fixing device 20 according to a first example embodiment that is incorporated in the image forming apparatus 1 described above.

FIG. 4 is a vertical sectional view of the fixing device 20. As shown in FIG. 4, the fixing device 20 (e.g., a fuser) includes a fixing belt 21 serving as a fixing rotary body or an endless belt formed into a loop and rotatable in a rotation direction R3; a pressing roller 22 serving as an opposed rotary body disposed opposite an outer circumferential surface of the fixing belt 21 and rotatable in a rotation direction R4 counter to the rotation direction R3 of the fixing belt 21; a halogen heater pair 23P constructed of two halogen heaters 23 (e.g., halogen lamps or heater lamps) serving as a heater disposed inside the loop formed by the fixing belt 21 and heating the fixing belt 21 by radiation heat; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heaters 23 toward the fixing belt 21; a thermopile 27 serving as a temperature detector disposed opposite the outer circumferential surface of the fixing belt 21 and detecting the temperature of the fixing belt 21; a thermistor 29 serving as a temperature detector disposed opposite an outer circumferential surface of the pressing roller 22 and detecting the temperature of the pressing roller 22; and a separator 28 disposed opposite the outer circumferential surface of the fixing belt 21 and separating a recording medium P discharged from the fixing nip N from the fixing belt 21. The fixing device 20 further includes a pressurization assembly that presses the pressing roller 22 against the nip formation assembly 24 via the fixing belt 21.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer, made of rubber such as silicone rubber, silicone rubber foam, and fluoro rubber, may be interposed between the base layer and the release layer.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a given length in the recording medium conveyance direction A1. A driver (e.g., a motor) disposed inside the image forming apparatus 1 depicted in FIG. 3 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21. Alternatively, the driver may be connected to the fixing belt 21 through a flange or connected to both the pressing roller 22 and the fixing belt 21.

According to this example embodiment, the pressing roller 22 is a hollow roller. Alternatively, the pressing roller 22 may be a solid roller. Optionally, a heater such as a halogen lamp may be disposed inside the hollow pressing roller 22. If the pressing roller 22 does not incorporate the elastic layer 22*b*, the pressing roller 22 has a decreased thermal capacity that improves fixing performance of being heated to a given fixing temperature quickly. However, as the pressing roller 22 and the fixing belt 21 sandwich and press a toner image T on the recording medium P passing through the fixing nip N, slight surface asperities of the fixing belt 21 may be transferred onto the toner image T on the recording medium P, resulting in variation in gloss of the solid toner image T. To address this problem, it is preferable that the pressing roller 22 incorporates the elastic layer 22*b* having a thickness not smaller than about 100 micrometers. The elastic layer 22*b* having the thickness not smaller than about 100 micrometers elastically deforms to absorb slight surface asperities of the fixing belt 21, preventing variation in gloss of the toner image T on the recording medium P. The elastic layer 22*b* may be made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21. According to this example embodiment, the pressing roller 22 is pressed against the fixing belt 21. Alternatively, the pressing roller 22 may merely contact the fixing belt 21 with no pressure therebetween.

A detailed description is now given of a construction of the halogen heater pair 23P.

Each halogen heater 23 of the halogen heater pair 23P is constructed of a luminous tube 230 and a filament 231 situated inside the luminous tube 230. For example, the luminous tube 230 is made of a luminous transmittance material such as silica glass and filled with inert gas. The filament 231 includes helically wound, tungsten elemental wires. An electrode is connected to each lateral end of the filament 231 in a longitudinal direction thereof parallel to an axial direction of the fixing belt 21. As a voltage is applied between the electrodes, the filament 231 is supplied with power and emits light.

Both lateral ends of each halogen heater 23 of the halogen heater pair 23P in a longitudinal direction thereof parallel to the axial direction of the fixing belt 21 are mounted on side plates of the fixing device 20. A power supply 91 situated inside the image forming apparatus 1 supplies power to each halogen heater 23 so that the halogen heater 23 heats the fixing belt 21. A controller 90 (e.g., a processor) is a central processing unit (CPU), provided with a random-access memory (RAM) and a read-only memory (ROM), for example, operatively connected to the halogen heaters 23 through the power supply 91 and the thermopile 27. The controller 90 controls the power supply 91 to supply power to the halogen heaters 23 based on the temperature of the fixing belt 21 detected by the thermopile 27 so as to adjust the temperature of the fixing belt 21 to a desired fixing temperature.

A detailed description is now given of a construction of the nip formation assembly 24.

The nip formation assembly 24 includes a base pad 241 and a slide sheet 240 (e.g., a low-friction sheet) covering an outer surface of the base pad 241. A longitudinal direction of the base pad 241 is parallel to the axial direction of the fixing belt 21 or the pressing roller 22. The base pad 241 receives pressure from the pressing roller 22 to define the shape of the fixing nip N. The base pad 241 is mounted on and supported by the stay 25. Accordingly, even if the base pad 241 receives pressure from the pressing roller 22, the base pad 241 is not bent by the pressure and therefore produces a uniform nip width throughout the axial direction of the pressing roller 22. The stay 25 is made of metal having an increased mechanical strength, such as stainless steel and iron, to prevent bending of the nip formation assembly 24. The base pad 241 is also made of a rigid material having an increased mechanical strength. For example, the base pad 241 is made of resin such as liquid crystal polymer (LCP), metal, ceramic, or the like.

Additionally, the base pad 241 is made of a heat-resistant material having a heat resistance against temperatures not lower than about 200 degrees centigrade. Accordingly, even if the base pad 241 is heated to a given fixing temperature range, the base pad 241 is not thermally deformed, thus retaining the desired shape of the fixing nip N stably and thereby maintaining the quality of the fixed toner image T on the recording medium P. For example, the base pad 241 is made of general heat-resistant resin such as polyether sulfone (PES), polyphenylene sulfide (PPS), LCP, polyether nitrile (PEN), polyamide imide (PAT), and polyether ether ketone (PEEK).

The slide sheet 240 is interposed at least between the base pad 241 and the fixing belt 21. For example, the slide sheet 240 covers at least an opposed face 241*a* of the base pad 241 disposed opposite the inner circumferential surface of the fixing belt 21 at the fixing nip N. As the fixing belt 21 rotates in the rotation direction R3, it slides over the slide sheet 240 with decreased friction therebetween, decreasing a driving torque exerted on the fixing belt 21. Alternatively, the nip formation assembly 24 may not incorporate the slide sheet 240.

A detailed description is now given of a construction of the reflector 26.

The reflector 26 is interposed between the stay 25 and the halogen heater pair 23P. For example, the reflector 26 is made of aluminum, stainless steel, or the like and attached to or mounted on the stay 25. The reflector 26 has a reflection face that reflects light radiated from the halogen heater pair 23P thereto toward the fixing belt 21. Accordingly, the fixing belt 21 receives an increased amount of light from the halogen heater pair 23P and thereby is heated efficiently. Additionally, the reflector 26 minimizes transmission of radiation heat from the halogen heater pair 23P to the stay 25, thus saving energy.

The fixing device 20 according to this example embodiment attains various improvements to save more energy and shorten a first print time taken to output a recording medium P bearing a fixed toner image T onto the outside of the image forming apparatus 1 depicted in FIG. 3 after the image forming apparatus 1 receives a print job.

As a first improvement, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm, preferably not greater than about 0.16 mm. Additionally, the loop diameter of the fixing belt 21 may be about 30 mm or smaller.

According to this example embodiment, the pressing roller 22 has a diameter in a range of from about 20 mm to about 40 mm so that the loop diameter of the fixing belt 21 is equivalent to the diameter of the pressing roller 22. However, the loop diameter of the fixing belt 21 and the diameter of the pressing roller 22 are not limited to the above. For example, the loop diameter of the fixing belt 21 may be smaller than the diameter of the pressing roller 22. In this case, a curvature of the fixing belt 21 at the fixing nip N is greater than that of the pressing roller 22, facilitating separation of the recording medium P discharged from the fixing nip N from the fixing belt 21.

Since the fixing belt 21 has a decreased loop diameter, space inside the loop formed by the fixing belt 21 is small. To address this circumstance, both ends of the stay 25 in the recording medium conveyance direction A1 are folded into a bracket that accommodates the halogen heater pair 23P. Thus, the stay 25 and the halogen heater pair 23P are placed in the small space inside the loop formed by the fixing belt 21.

As a second improvement, in contrast to the stay 25, the nip formation assembly 24 is compact, thus allowing the stay 25 to extend as long as possible in the small space inside the loop formed by the fixing belt 21. For example, the length of the base pad 241 of the nip formation assembly 24 is smaller than that of the stay 25 in the recording medium conveyance direction A1. As shown in FIG. 4, the base pad 241 includes an upstream portion 24*a* disposed upstream from the fixing nip N in the recording medium conveyance direction A1; a downstream portion 24*b* disposed downstream from the fixing nip N in the recording medium conveyance direction A1; and a center portion 24*c* interposed between the upstream portion 24*a* and the downstream portion 24*b* in the recording medium conveyance direction A1. A height h1 defines a height of the upstream portion 24*a* from the fixing nip N or its hypothetical extension E in a pressurization direction D1 of the pressing roller 22 in which the pressing roller 22 is pressed against the nip formation assembly 24. A height h2 defines a height of the downstream portion 24*b* from the fixing nip N or its hypothetical extension E in the pressurization direction D1 of the pressing roller 22. A height h3, that is, a maximum height of the base pad 241, defines a height of the center portion 24*c* from the fixing nip N or its hypothetical extension E in the pressurization direction D1 of the pressing roller 22. The height h3 is not smaller than the height h1 and the height h2.

Hence, the upstream portion 24*a* of the base pad 241 of the nip formation assembly 24 is not interposed between the inner circumferential surface of the fixing belt 21 and an upstream curve 25*d*1 of the stay 25 in a diametrical direction of the fixing belt 21. Similarly, the downstream portion 24*b* of the base pad 241 of the nip formation assembly 24 is not interposed between the inner circumferential surface of the fixing belt 21 and a downstream curve 25*d*2 of the stay 25 in the diametrical direction of the fixing belt 21. Accordingly, the upstream curve 25*d*1 and the downstream curve 25*d*2 of the stay 25 are situated in proximity to the inner circumferential surface of the fixing belt 21. Consequently, the stay 25 having an increased size that enhances the mechanical strength thereof is accommodated in the limited space inside the loop formed by the fixing belt 21. As a result, the stay 25, with its enhanced mechanical strength, supports the nip formation assembly 24 properly, preventing bending of the nip formation assembly 24 caused by pressure from the pressing roller 22 and thereby improving fixing performance.

As shown in FIG. 4, the stay 25 includes a base 25*a* contacting the nip formation assembly 24 and an upstream arm 25*b*1 and a downstream arm 25*b*2, constituting a pair of projections, projecting from the base 25*a*. The base 25*a* extends in the recording medium conveyance direction A1, that is, a vertical direction in FIG. 4. The upstream arm 25*b*1 and the downstream arm 25*b*2 project from an upstream end and a downstream end of the base 25*a*, respectively, in the recording medium conveyance direction A1 and extend in the pressurization direction D1 of the pressing roller 22 orthogonal to the recording medium conveyance direction A1. The upstream arm 25*b*1, and the downstream arm 25*b*2 projecting from the base 25*a* in the pressurization direction D1 of the pressing roller 22 elongate a cross-sectional area of the stay 25 in the pressurization direction D1 of the pressing roller 22, increasing the section modulus and the mechanical strength of the stay 25.

Additionally, as the upstream arm 25*b*1 and the downstream arm 25*b*2 elongate further in the pressurization direction D1 of the pressing roller 22, the mechanical strength of the stay 25 becomes greater. Accordingly, it is preferable that a front edge 25*c* of each of the upstream arm 25*b*1 and the downstream aim 25*b*2 is situated as close as possible to the inner circumferential surface of the fixing belt 21 to allow the upstream arm 25*b*1 and the downstream arm 25*b*2 to project longer from the base 25*a* in the pressurization direction D1 of the pressing roller 22. However, since the fixing belt 21 swings or vibrates as it rotates, if the front edge 25*c* of each of the upstream arm 25*b*1 and the downstream arm 25*b*2 is excessively close to the inner circumferential surface of the fixing belt 21, the swinging or vibrating fixing belt 21 may come into contact with the upstream arm 25*b*1 or the downstream arm 25*b*2. For example, if the thin fixing belt 21 is used as in this example embodiment, the thin fixing belt 21 swings or vibrates substantially. Accordingly, it is necessary to position the front edge 25*c* of each of the upstream arm 25*b*1 and the downstream arm 25*b*2 with respect to the fixing belt 21 carefully.

Specifically, as shown in FIG. 4, a distance d between the front edge 25*c* of each of the upstream arm 25*b*1 and the downstream arm 25*b*2 and the inner circumferential surface of the fixing belt 21 in the pressurization direction D1 of the pressing roller 22 is at least about 2.0 mm, preferably not smaller than about 3.0 mm. Conversely, if the fixing belt 21 is thick and therefore barely swings or vibrates, the distance d is about 0.02 mm.

The front edge 25*c* of each of the upstream arm 25*b*1 and the downstream arm 25*b*2 situated as close as possible to the inner circumferential surface of the fixing belt 21 allows the upstream arm 25*b*1 and the downstream arm 25*b*2 to project longer from the base 25*a* in the pressurization direction D1 of the pressing roller 22. Accordingly, even if the fixing belt 21 has a decreased loop diameter, the stay 25 having the longer upstream arm 25*b*1 and the longer downstream arm 25*b*2 attains an enhanced mechanical strength.

Figure 5A:
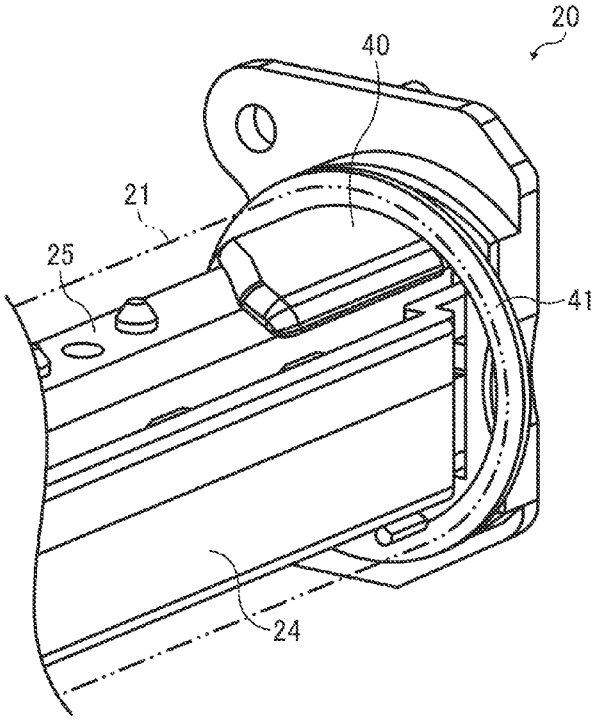
FIG. 5A is a partial perspective view of the fixing device shown in FIG. 4 illustrating one lateral end of a fixing belt incorporated therein in an axial direction of the fixing belt.
Figure 5B:
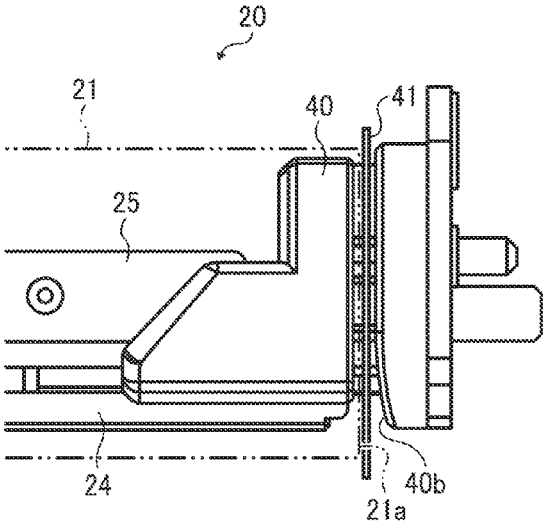
FIG. 5B is a partial plan view of the fixing device illustrating one lateral end of the fixing belt in the axial direction thereof.
Figure 5C:
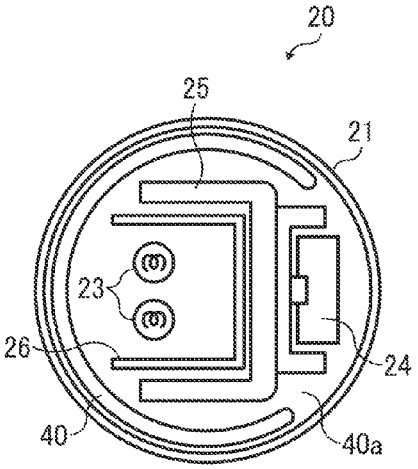
FIG. 5C is a vertical sectional view of the fixing device at one lateral end of the fixing belt in the axial direction thereof.

With reference to FIGS. 5A, 5B, and 5C, a description is provided of a configuration of a lateral end of the fixing belt 21 in the axial direction thereof.

FIG. 5A is a partial perspective view of the fixing device 20 illustrating one lateral end of the fixing belt 21 in the axial direction thereof. FIG. 5B is a partial plan view of the fixing device 20 illustrating one lateral end of the fixing belt 21 in the axial direction thereof. FIG. 5C is a vertical sectional view of the fixing device 20 at one lateral end of the fixing belt 21 in the axial direction thereof. Although not shown, another lateral end of the fixing belt 21 in the axial direction thereof has the identical configuration shown in FIGS. 5A to 5C. Hence, the following describes the configuration of one lateral end of the fixing belt 21 in the axial direction thereof with reference to FIGS. 5A to 5C.

As shown in FIGS. 5A and 5B, a substantially tubular belt holder 40 is loosely fitted into the loop formed by the fixing belt 21 at each lateral end of the fixing belt 21 in the axial direction thereof to rotatably support each lateral end of the fixing belt 21 in the axial direction thereof. As shown FIG. 5C, the belt holder 40 is formed into a C-shape in cross-section to create a slit 40*a* at the fixing nip N where the nip formation assembly 24 is situated. As shown in FIG. 5A, each lateral end of the stay 25 in a longitudinal direction thereof parallel to the axial direction of the fixing belt 21 is mounted on and positioned by the belt holder 40.

As shown in FIG. 5B, a slip ring 41 is interposed between a lateral edge 21*a* of the fixing belt 21 and an inward face 40*b* of the belt holder 40 disposed opposite the lateral edge 21*a* of the fixing belt 21 in the axial direction thereof. The slip ring 41 serves as a protector that protects the lateral end of the fixing belt 21 in the axial direction thereof. For example, even if the fixing belt 21 is skewed in the axial direction thereof, the slip ring 41 prevents the lateral edge 21*a* of the fixing belt 21 from coming into direct contact with the inward face 40*b* of the belt holder 40, thus minimizing abrasion and breakage of the lateral edge 21*a* of the fixing belt 21 in the axial direction thereof. Since an inner diameter of the slip ring 41 is sufficiently greater than an outer diameter of the belt holder 40, the slip ring 41 loosely slips on the belt holder 40. Hence, if the lateral edge 21*a* of the fixing belt 21 contacts the slip ring 41, the slip ring 41 rotates in accordance with rotation of the fixing belt 21. Alternatively, the slip ring 41 may be stationary and therefore may not rotate in accordance with rotation of the fixing belt 21. The slip ring 41 is made of heat-resistant, super engineering plastics such as PEEK, PPS, PAI, and PTFE.

A thermal shield is interposed between each halogen heater 23 of the halogen heater pair 23P and the fixing belt 21 at each lateral end of the fixing belt 21 in the axial direction thereof. The thermal shield shields the fixing belt 21 against heat from the halogen heater 23. For example, even if a plurality of small recording media P is conveyed through the fixing nip N continuously, the thermal shield prevents heat from the halogen heater 23 from being conducted to each lateral end of the fixing belt 21 in the axial direction thereof where the small recording media P are not conveyed. Accordingly, each lateral end of the fixing belt 21 does not overheat even in the absence of large recording media P that draw heat therefrom. Consequently, the thermal shield minimizes thermal wear and damage of the fixing belt 21.

With reference to FIG. 4, a description is provided of a fixing operation of the fixing device 20 described above.

As the image forming apparatus 1 depicted in FIG. 3 is powered on, the power supply supplies power to the halogen heater pair 23P and at the same time the driver drives and rotates the pressing roller 22 clockwise in FIG. 4 in the rotation direction R4. Accordingly, the fixing belt 21 rotates counterclockwise in FIG. 4 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate 37 and enters the fixing nip N formed between the pressing roller 22 and the fixing belt 21 pressed by the pressing roller 22. The fixing belt 21 heated by the halogen heater pair 23P heats the recording medium P and at the same time the pressing roller 22 pressed against the fixing belt 21 and the fixing belt 21 together exert pressure to the recording medium P, thus fixing the toner image T on the recording medium P.

The recording medium P bearing the fixed toner image T is discharged from the fixing nip N in a recording medium conveyance direction A2. As a leading edge of the recording medium P discharged from the fixing nip N comes into contact with a front edge of the separator 28, the separator 28 separates the recording medium P from the fixing belt 21. Thereafter, the separated recording medium P is discharged by the output roller pair 13 depicted in FIG. 3 onto the outside of the image forming apparatus 1, that is, the output tray 14 where the recording media P are stocked.

Figure 6A:
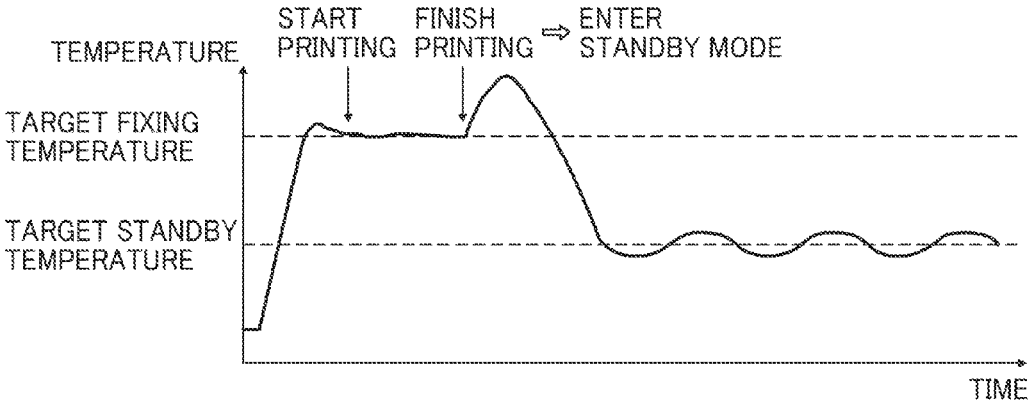
FIG. 6A is a graph showing a relation between time and the temperature of the fixing belt shown in FIG. 5A before and after printing.
Figure 6B:
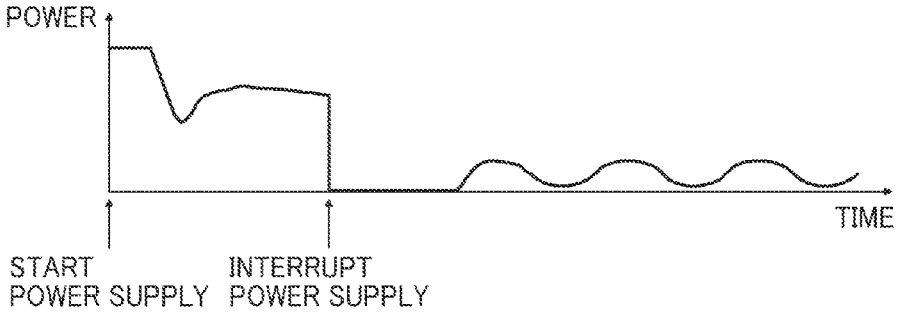
FIG. 6B is a graph showing a relation between time and the amount of power supplied to a halogen heater pair incorporated in the fixing device shown in FIG. 4 corresponding to the temperature of the fixing belt changing over time shown in FIG. 6A.

With reference to FIGS. 6A and 6B, a description is provided of one example of a temperature control of the fixing belt 21 performed by the fixing device 20.

FIG. 6A is a graph showing a relation between time and the temperature of the fixing belt 21 before and after printing. FIG. 6B is a graph showing a relation between time and the amount of power supplied to the halogen heater pair 23P corresponding to the temperature of the fixing belt 21 changing over time shown in FIG. 6A.

Upon receipt of a print job from a user, the controller 90 depicted in FIG. 4 controls the power supply 91 to start power supply to the halogen heater pair 23P, thus starting warm-up of the fixing belt 21 as shown in FIG. 6B. Accordingly, the temperature of the fixing belt 21 increases as shown in FIG. 6A. When the temperature of the fixing belt 21 detected by the thermopile 27 reaches a target fixing temperature shown in FIG. 6A and a given time elapses, a recording medium P bearing a toner image T is conveyed through the fixing nip N where the fixing belt 21 and the pressing roller 22 apply heat and pressure to the recording medium P to fix the toner image T on the recording medium P. While the recording medium P is conveyed through the fixing nip N, the recording medium P draws heat from the fixing belt 21, decreasing the temperature of the fixing belt 21. To address this circumstance, the controller 90 controls the power supply 91 to adjust power supply to the halogen heater pair 23P based on the temperature of the fixing belt 21 detected by the thermopile 27 and the target fixing temperature, thus adjusting the temperature of the fixing belt 21 to the target fixing temperature.

The target fixing temperature is determined based on the paper weight of the recording medium P, the temperature and humidity of an environment of the image forming apparatus 1, and the like. For example, the target fixing temperature is about 160 degrees centigrade for the recording medium P having the paper weight of about 70 g/m$^2$ at the temperature of about 23 degrees centigrade and the humidity of about 50 percent. The target fixing temperature is about 180 degrees centigrade for the recording medium P having the paper weight of about 100 g/m$^2$ at the temperature of about 10 degrees centigrade and the humidity of about 30 percent.

When the print job is finished and the last recording medium P of the print job is discharged from the fixing nip N, the fixing device 20 waits for a next print job in a standby mode in which rotation of the pressing roller 22 and the fixing belt 21 is interrupted and the fixing belt 21 is maintained at a target standby temperature. As shown in FIG. 6A, the target standby temperature is lower than the target fixing temperature. In order to save energy further, when the image forming apparatus 1 does not receive a next print job even after a given period elapses, the fixing device 20 may enter a sleep mode, instead of the standby mode, in which the controller 90 controls the power supply 91 to interrupt power supply to the halogen heater pair 23P.

As shown in FIGS. 6A and 6B, when the print job is finished, power supply to the halogen heater pair 23P is interrupted. However, even after the halogen heater pair 23P is turned off, as heated air surrounding the halogen heater pair 23P moves to the fixing belt 21, the heated air increases the temperature of the fixing belt 21 substantially after the print job is finished as shown in FIG. 6A, thus overshooting the target fixing temperature.

A detailed description is now given of overshooting.

While the recording medium P is conveyed through the fixing nip N during printing, the recording medium P draws heat from the fixing belt 21, maintaining a balance between an amount of heat supplied from the halogen heater pair 23P to the fixing belt 21 and an amount of heat drawn to the recording medium P. However, when the print job is finished, there is no recording medium P passing through the fixing nip N and drawing heat from the fixing belt 21, tipping the balance. Accordingly, an excessive amount of heat that cannot escape to the recording medium P may remain inside the loop formed by the fixing belt 21. Additionally, heated air surrounding the halogen heater pair 23P may not diffuse to the outside of the loop formed by the fixing belt 21 and therefore may heat the inner circumferential surface of the fixing belt 21. Accordingly, when the print job is finished and the fixing belt 21 interrupts its rotation, heated air surrounding the halogen heater pair 23P heats the fixing belt 21 locally. Consequently, the temperature of the fixing belt 21 increases substantially, overshooting the target fixing temperature.

For example, as shown in FIG. 4, since the halogen heater pair 23P is substantially housed by the bracket-shaped reflector 26, heat radiated from the halogen heater pair 23P onto the fixing belt 21 through an opening 26*a* of the reflector 26 is concentrated on a part of the fixing belt 21 that faces the opening 26*a* of the reflector 26. Accordingly, residual heat remaining in the halogen heater pair 23P when the print job is finished dissipates by convection from the opening 26*a* of the reflector 26 to that part of the fixing belt 21 that faces the opening 26*a* of the reflector 26. Consequently, the temperature of the fixing belt 21 increases locally.

As the temperature of the fixing belt 21 increases locally, the fixing belt 21 may be deformed by thermal stress induced therein or broken by overheating. Such deformation of the fixing belt 21 by thermal stress is noticeable in a configuration in which the fixing belt 21 has a decreased thickness and a decreased loop diameter that decrease the thermal capacity thereof and the halogen heater pair 23P is disposed in proximity to the inner circumferential surface of the fixing belt 21 and therefore a part of the fixing belt 21 is subject to overheating. Even if the temperature of the fixing belt 21 is below its heat resistant temperature, repeated deformation of the fixing belt 21 caused by the local temperature increase of the fixing belt 21 may shorten the life of the fixing belt 21.

To prevent overshooting, the fixing belt 21 may continue its rotation for a given time while power supply to the halogen heater pair 23P is interrupted after the print job is finished, thus facilitating thermal dissipation and diffusion from the fixing belt 21. However, continuation of rotation of the fixing belt 21 may raise problems of noise and waste of power. Further, extension of rotation of the fixing belt 21 may accelerate wear of the fixing belt 21, shortening the life of the fixing belt 21. To address those problems, the fixing device 20 according to this example embodiment suppresses overshooting as described below.

Figure 7:
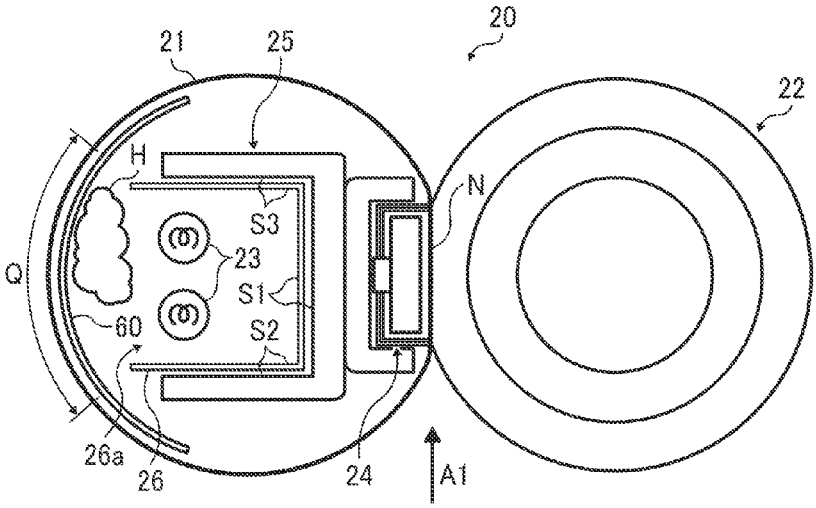
FIG. 7 is a partial vertical sectional view of the fixing device shown in FIG. 4.

With reference to FIG. 7, a description is provided of a configuration of the fixing device 20 that suppresses overshooting.

FIG. 7 is a partial vertical sectional view of the fixing device 20. As shown in FIG. 7, the fixing device 20 further includes a shield 60 located between the opening 26*a* of the reflector 26 and the inner circumferential surface of the fixing belt 21 in the diametrical direction thereof. The shield 60 is made of a transparent or translucent material through which light from the halogen heaters 23 passes. For example, the shield 60 is made of transparent silica glass having an increased luminous transmittance.

The shield 60 has a long length extending in the axial direction of the fixing belt 21. That is, the shield 60 faces at least a heat generation span of each halogen heater 23 spanning in the axial direction of the fixing belt 21. Both lateral ends of the shield 60 in a longitudinal direction thereof parallel to the axial direction of the fixing belt 21 are attached to or mounted on the side plates of the fixing device 20. The shield 60 faces at least an irradiation span Q of the fixing belt 21 spanning in a circumferential direction thereof that is irradiated with light from the halogen heaters 23. As shown in FIG. 7, the shield 60 is curved into an arc in cross-section corresponding to the inner circumferential surface of the fixing belt 21. Alternatively, the shield 60 may have other shapes in cross-section.

The shield 60 interposed between the halogen heaters 23 and the inner circumferential surface of the fixing belt 21 blocks movement of heated air H surrounding the halogen heaters 23 toward the fixing belt 21, thus reducing the heated air H that may come into direct contact with the fixing belt 21. Accordingly, after the print job is finished and therefore the halogen heaters 23 are turned off, the heated air H surrounding the halogen heaters 23 does not move to and heat the fixing belt 21 and thereby does not increase the temperature of the fixing belt 21 over the irradiation span Q of the fixing belt 21. Consequently, deformation, damage, and wear of the fixing belt 21 are minimized.

On the other hand, light emitted from the halogen heaters 23 passes through the shield 60 and heats the fixing belt 21 sufficiently, achieving improved fixing performance.

Figure 8:
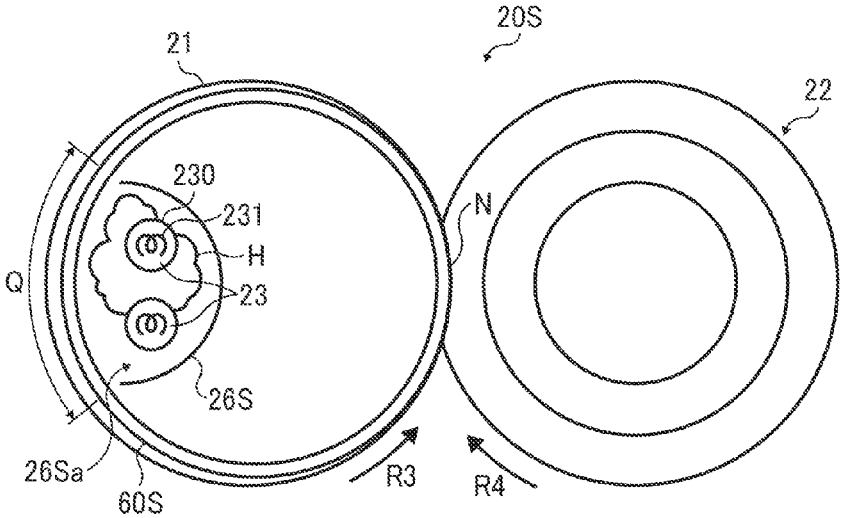
FIG. 8 is a vertical sectional view of a fixing device according to a second example embodiment of the present invention.

Additionally, the stay 25 and the reflector 26 accommodating and substantially surrounding the halogen heaters 23 prevent the heated air H from moving upward, thus minimizing overheating of the fixing belt 21 precisely. According to this example embodiment, the stay 25 and the reflector 26 serve as a casing that houses the halogen heaters 23 with three sides of the stay 25 and the reflector 26, that is, a first side S1 extending parallel to the recording medium conveyance direction A1, a second side S2 projecting from an upstream end of the first side S1 in the recording medium conveyance direction A1 and extending in a direction orthogonal to the recording medium conveyance direction A1, and a third side S3 projecting from a downstream end of the first side S1 in the recording medium conveyance direction A1 and extending in the direction orthogonal to the recording medium conveyance direction A1. Alternatively, only the stay 25 may surround the halogen heaters 23 with the three sides of the stay 25. In this case also, the stay 25 prevents the heated air H from moving upward. In order to prevent overheating of the stay 25, the stay 25 is made of metal having a relatively great thermal capacity, such as SUS stainless steel. With reference to FIG. 8, a description is provided of a configuration of a fixing device 20S according to a second example embodiment.

FIG. 8 is a vertical sectional view of the fixing device 20S. As shown in FIG. 8, the fixing device 20S includes a tubular shield 60S instead of the arcuate shield 60 depicted in FIG. 7. The halogen heaters 23 and a semicylindrical reflector 26S are situated inside the shield 60S. The semicylindrical reflector 26S has an opening 26Sa facing the irradiation span Q of the fixing belt 21 disposed opposite the fixing nip N via the reflector 26S. Thus, the opening 26Sa is disposed opposite the irradiation span Q of the fixing belt 21 via the shield 60S. Alternatively, the reflector 26S may have other shapes. The halogen heaters 23 are situated in a space enclosed by the reflector 26S and the shield 60S, that is, a compartment created by the reflector 26S and the shield 60S.

The pressing roller 22 is pressed against the shield 60S via the fixing belt 21 to form the fixing nip N between the pressing roller 22 and the fixing belt 21. That is, the fixing device 20S does not incorporate the nip formation assembly 24 depicted in FIG. 7. The shield 60S is stationarily mounted on side plates of the fixing device 20S. Hence, as the pressing roller 22 rotates in the rotation direction R4, the fixing belt 21 rotates in accordance with rotation of the pressing roller 22 by friction therebetween, but the shield 60S does not rotate.

Like the shield 60 depicted in FIG. 7, the shield 60S is made of a transparent or translucent material through which light from the halogen heaters 23 passes. Accordingly, light emitted from the halogen heaters 23 passes through the shield 60S and irradiates the fixing belt 21. The shield 60S prevents heated air H surrounding the halogen heaters 23 from moving to the fixing belt 21. Since the tubular shield 60S is disposed opposite the entire inner circumferential surface of the fixing belt 21 in the circumferential direction thereof, the shield 60S shields the fixing belt 21 from the heated air H surrounding the halogen heaters 23, preventing the heated air H from coming into contact with the fixing belt 21. Accordingly, after the print job is finished, the shield 60S prevents the heated air H from heating the fixing belt 21, thus reducing temperature increase of the irradiation span Q of the fixing belt 21 effectively.

Figure 9:
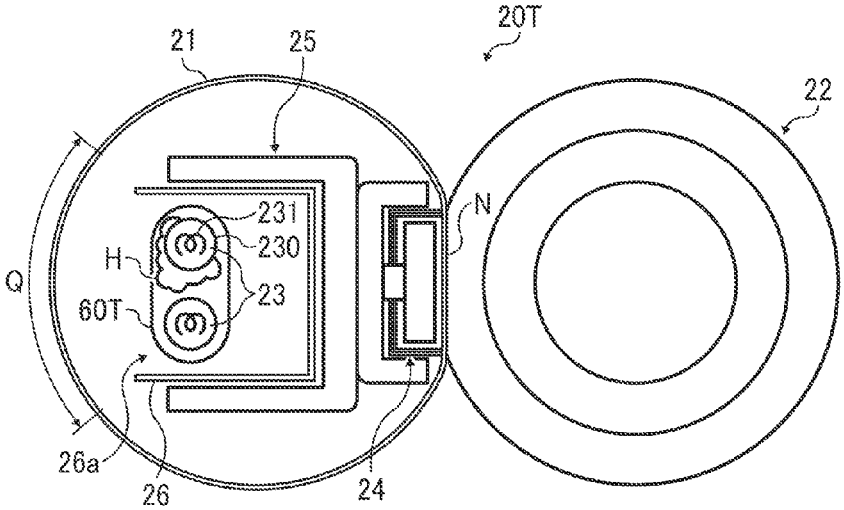
FIG. 9 is a vertical sectional view of a fixing device according to a third example embodiment of the present invention.

With reference to FIG. 9, a description is provided of a configuration of a fixing device 20T according to a third example embodiment.

FIG. 9 is a vertical sectional view of the fixing device 20T. The fixing device 20T includes, instead of the shield 60 depicted in FIG. 7, a shield 60T formed into an elliptic cylinder and surrounding the halogen heaters 23 throughout the circumferential direction of the fixing belt 21.

Since the shield 60T formed into the elliptic cylinder surrounds the halogen heaters 23 throughout the circumferential direction of the fixing belt 21, the shield 60T shields the fixing belt 21 from the heated air H surrounding the halogen heaters 23, preventing the heated air H from coming into contact with the fixing belt 21. Accordingly, after the print job is finished, the shield 60T prevents the heated air H from heating the fixing belt 21, thus reducing temperature increase of the irradiation span Q of the fixing belt 21 effectively. Alternatively, in addition to the heat generation span of each halogen heater 23 in the longitudinal direction thereof, the shield 60T may also surround both lateral ends of each halogen heater 23 disposed outboard from the heat generation span of each halogen heater 23 in the longitudinal direction thereof. Accordingly, the shield 60T may retain the heated air H inside it precisely, preventing the heated air H from moving to and heating the fixing belt 21. Like the shield 60 depicted in FIG. 7, the shield 60T is made of a transparent or translucent material through which light from the halogen heaters 23 passes. Accordingly, light emitted from the halogen heaters 23 passes through the shield 60T and irradiates the fixing belt 21. Thus, the halogen heaters 23 heat the fixing belt 21 sufficiently, achieving improved fixing performance.

Figure 10:
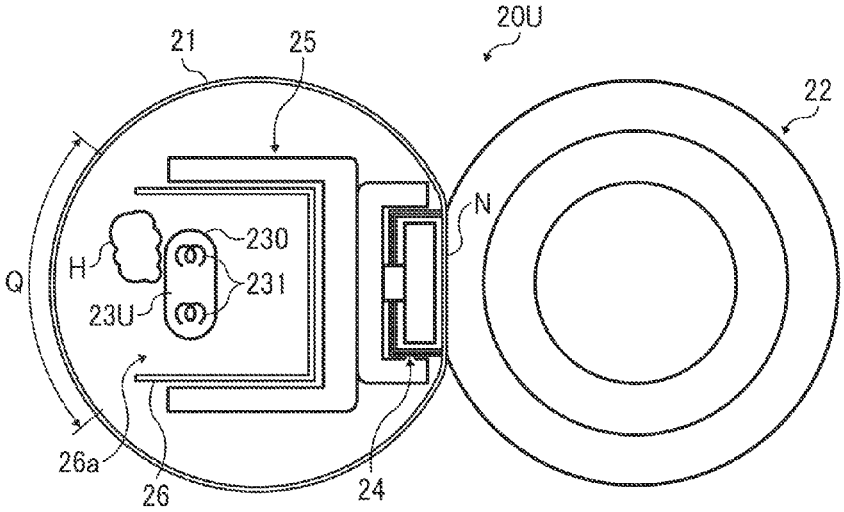
FIG. 10 is a vertical sectional view of a fixing device according to a fourth example embodiment of the present invention.

With reference to FIG. 10, a description is provided of a configuration of a fixing device 20U according to a fourth example embodiment.

FIG. 10 is a vertical sectional view of the fixing device 20U. As shown in FIG. 10, the fixing device 20U includes, instead of the halogen heaters 23 depicted in FIG. 7 each of which includes the single luminous tube 230 and the single filament 231 depicted in FIG. 4, a halogen heater 23U constructed of a single luminous tube 230 and two filaments 231 situated inside the luminous tube 230. The single luminous tube 230 accommodating the plurality of filaments 231 has a reduced surface area where the luminous tube 230 contacts outside air that may be heated by the halogen heater 23U. Hence, an amount of heated air H surrounding and being heated by the halogen heater 23U is reduced. Accordingly, after the print job is finished, the halogen heater 23U reduces an amount of heated air H moving from the halogen heater 23U and coming into direct contact with the fixing belt 21, thus preventing temperature increase of the irradiation span Q of the fixing belt 21 caused by the heated air H.

In the fixing device 20U depicted in FIG. 10, there is no shield located inside the fixing belt 21. Alternatively, the fixing device 20U may incorporate any one of the shields 60, 60S, and 60T depicted in FIGS. 7, 8, and 9, respectively. In this case, the shields 60, 60S, and 60T shield the fixing belt 21 from the heated air H, preventing the heated air H from coming into contact with the fixing belt 21 and therefore reducing temperature increase of the irradiation span Q of the fixing belt 21 effectively.

A thermal resistance of the shields 60, 60S, and 60T may be greater than that of the fixing belt 21 to reduce heating of the shields 60, 60S, and 60T by the heated air H surrounding the halogen heaters 23. Accordingly, even if the heated air H surrounding the halogen heaters 23 contacts the shields 60, 60S, and 60T, the greater thermal resistance of the shields 60, 60S, and 60T obstructs conduction of the heated air H to the shields 60, 60S, and 60T, causing substantial temperature decrease inside the shields 60, 60S, and 60T. Consequently, the surface temperature of the shields 60, 60S, and 60T becomes lower than the temperature of the inner circumferential surface of the fixing belt 21, thus preventing overheating of the fixing belt 21 effectively.

The present invention is not limited to the details of the example embodiments described above, and various modifications and improvements are possible. For example, according to the example embodiments described above, the halogen heaters 23 and 23U are used as a heater for heating the fixing belt 21. Alternatively, an infrared heater, a heater that emits light other than infrared rays, or the like may be used as a heater.

Figure 11:
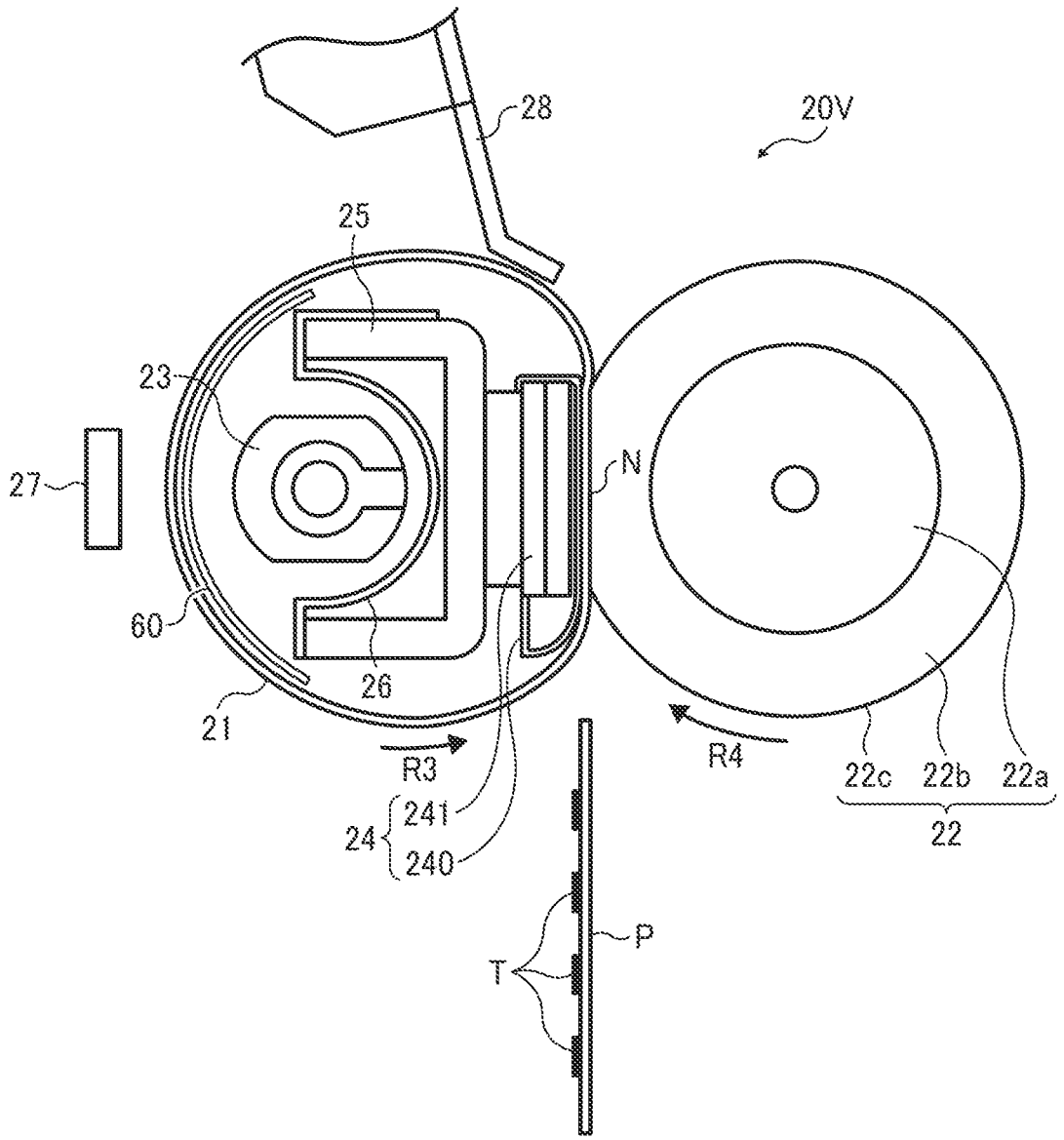
FIG. 11 is a vertical sectional view of a fixing device according to a fifth example embodiment of the present invention.
Figure 12:
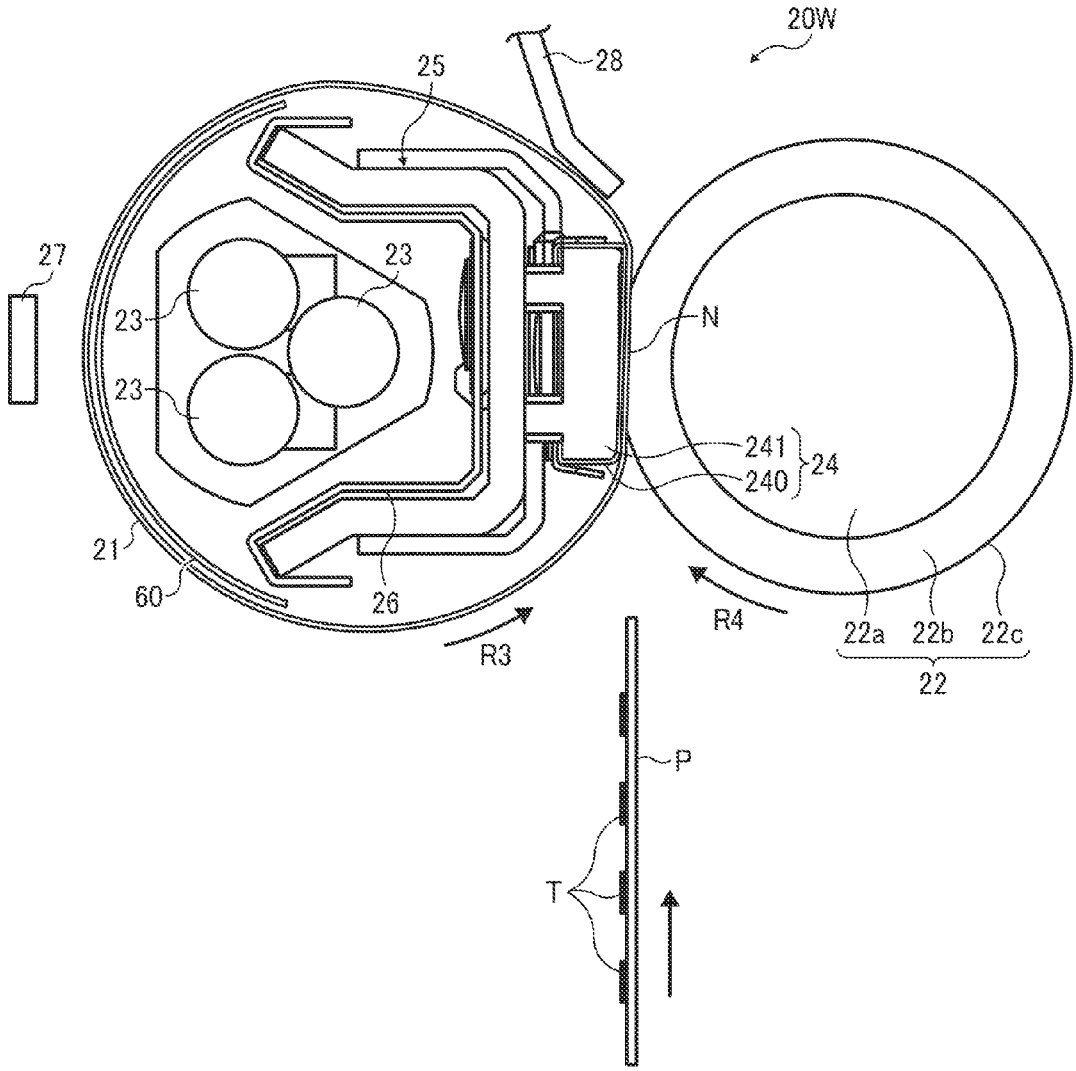
FIG. 12 is a vertical sectional view of a fixing device according to a sixth example embodiment of the present invention.

Yet alternatively, the example embodiments shown in FIGS. 7 to 10 may be applicable to a fixing device 20V shown in FIG. 11 that incorporates the single halogen heater 23, a fixing device 20W shown in FIG. 12 that incorporates the three halogen heaters 23, and a fixing device that incorporates four or more halogen heaters.

FIG. 11 is a vertical sectional view of the fixing device 20V according to a fifth example embodiment. As shown in FIG. 11, the single halogen heater 23 is interposed between the reflector 26 attached to or mounted on the stay 25 and the inner circumferential surface of the fixing belt 21 in the diametrical direction thereof. FIG. 12 is a vertical sectional view of the fixing device 20W according to a sixth example embodiment. As shown in FIG. 12, the three halogen heaters 23 are interposed between the reflector 26 attached to or mounted on the stay 25 and the inner circumferential surface of the fixing belt 21 in the diametrical direction thereof.

Additionally, as shown in FIG. 3, the image forming apparatus 1 incorporating the fixing device 20, 20S, 20T, 20U, 20V, or 20W is a color laser printer. Alternatively, the image forming apparatus 1 may be a monochrome printer, a copier, a facsimile machine, a multifunction printer (MFP) having at least one of copying, printing, facsimile, and scanning functions, or the like.

As described above, after the print job is finished, that is, after the halogen heaters 23 and 23U are turned off, the shields 60, 60S, and 60T and the halogen heater 23U prevent heated air H surrounding the halogen heaters 23 and 23U from heating the irradiation span Q of the fixing belt 21 while the fixing belt 21 interrupts its rotation. Accordingly, thermal deformation, damage, and wear of the fixing belt 21 are prevented. Consequently, the life of the fixing belt 21 is improved and performance of the fixing belt 21 is retained, maintaining the improved quality of the fixed toner image T on the recording medium P over an extended period of time. Additionally, overheating of the fixing belt 21 is suppressed, achieving safety of the fixing devices 20, 20S, 20T, 20U, 20V, and 20W.

The fixing devices 20, 20S, 20T, 20U, 20V, and 20W include the thin fixing belt 21 having a decreased loop diameter to decrease the thermal capacity thereof. The inner circumferential surface of the fixing belt 21 is contacted by the nip formation assembly 24 and the belt holder 40 and heated by the heater (e.g., the halogen heaters 23 and 23U) disposed in proximity to the fixing belt 21 over the irradiation span Q of the fixing belt 21. Therefore, the irradiation span Q of the fixing belt 21 is subject to overheating after the print job is finished and therefore the fixing belt 21 interrupts its rotation. To address this problem, the fixing devices 20, 20S, 20T, 20U, 20V, and 20W employ the shields 60, 60S, and 60T and the heater that prevent or reduce heated air H surrounding the heater from moving to and heating the irradiation span Q of the fixing belt 21, attaining advantages described below. A description is provided of advantages of the fixing devices 20, 20S, 20T, 20U, 20V, and 20W.

The fixing device (e.g., the fixing devices 20, 20S, 20T, 20U, 20V, and 20W) includes an endless belt (e.g., the fixing belt 21) rotatable in the rotation direction R3; an opposed rotary body (e.g., the pressing roller 22) contacting the endless belt to form the fixing nip N therebetween; and a heater (e.g., the halogen heaters 23 and 23U) disposed in proximity to the irradiation span Q spanning on the inner circumferential surface of the endless belt in the circumferential direction thereof to emit light that irradiates the irradiation span Q of the endless belt. The fixing device further includes a shield (e.g., the shields 60, 60S, and 60T) interposed between the heater and the irradiation span Q of the endless belt in a diametrical direction of the endless belt to shield the irradiation span Q of the endless belt from heated air H surrounding the heater, thus preventing the heated air H from moving to and heating the irradiation span Q of the endless belt and therefore preventing or minimizing overheating of the endless belt.

With this configuration, the heated air H surrounding the heater does not heat the endless belt locally, that is, does not heat the irradiation span Q of the endless belt, preventing local heating of the endless belt that may result in deformation, damage, and wear of the endless belt. Further, overheating of the endless belt is prevented, improving safety of the fixing device.

According to the example embodiments described above, the fixing belt 21 serves as an endless belt. Alternatively, a fixing film or the like may serve as an endless belt. Further, the pressing roller 22 serves as an opposed rotary body disposed opposite the endless belt. Alternatively, a pressing belt or the like may serve as an opposed rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

an endless belt formed into a loop and rotatable in a given direction of rotation;

an opposed rotary body contacting the endless belt to form a fixing nip therebetween through which a recording medium bearing a toner image is conveyed;

a heater disposed in proximity to an irradiation span spanning on an inner circumferential surface of the endless belt in a circumferential direction thereof to emit light that irradiates and heats the irradiation span of the endless belt;

a shield interposed between the heater and the irradiation span of the endless belt in a diametrical direction thereof to shield the irradiation span of the endless belt from heated air surrounding the heater: and a casing disposed inside the loop formed by the endless belt and substantially housing the heater, the casing including an opening disposed opposite the irradiation span of the endless belt, wherein the shield is interposed between the opening of the casing and the inner circumferential surface of the endless belt.

2. The fixing device according to claim 1, wherein the heater includes:

a luminous tube made of a luminous transmittance material; and a filament situated inside the luminous tube to emit the light.

3. The fixing device according to claim 1, wherein the heater includes a halogen heater.

4. The fixing device according to claim 1, wherein the shield is made of one of a transparent material and a translucent material through which the light emitted from the heater passes.

5. The fixing device according to claim 1, wherein the casing further includes a reflector to reflect the light emitted from the heater toward the inner circumferential surface of the endless belt.

6. The fixing device according to claim 5, wherein the casing further includes a stay mounting the reflector.

7. The fixing device according to claim 1, wherein the shield is formed into an arc in cross-section substantially corresponding to the irradiation span of the endless belt.

8. The fixing device according to claim 1, wherein the shield is formed into a tube facing the entire inner circumferential surface of the endless belt.

9. The fixing device according to claim 8, further comprising a semicylindrical reflector substantially housing the heater to reflect the light emitted from the heater, the reflector including an opening disposed opposite the irradiation span of the endless belt via the shield.

10. The fixing device according to claim 1, wherein the shield is formed into an elliptic cylinder surrounding the heater throughout the circumferential direction of the endless belt.

11. The fixing device according to claim 1, wherein the shield is made of silica glass.

12. The fixing device according to claim 1, wherein a thermal resistance of the shield is greater than a thermal resistance of the endless belt.

13. The fixing device according to claim 1, wherein the opposed rotary body includes a pressing roller.

14. An image forming apparatus comprising the fixing device according to claim 1.

15. A fixing device comprising:

an endless belt formed into a loop and rotatable in a given direction of rotation;

an opposed rotary body contacting the endless belt to form a fixing nip therebetween through which a recording medium bearing a toner image is conveyed; and a heater disposed in proximity to an irradiation span spanning on an inner circumferential surface of the endless belt in a circumferential direction thereof to emit light that irradiates and heats the irradiation span of the endless belt, the heater including:

a luminous tube made of a luminous transmittance material; and a plurality of filaments situated inside the luminous tube to emit the light.

16. The fixing device according to claim 15, further comprising a casing disposed inside the loop formed by the endless belt and substantially housing the heater, the casing including an opening disposed opposite the irradiation span of the endless belt.

17. The fixing device according to claim 16, wherein the casing further includes a reflector to reflect the light emitted from the heater toward the inner circumferential surface of the endless belt.

18. The fixing device according to claim 17, wherein the casing further includes a stay mounting the reflector.

19. A fixing device comprising:

an endless belt formed into a loop and rotatable in a given direction of rotation;

an opposed rotary body contacting the endless belt to form a fixing nip therebetween through which a recording medium bearing a toner image is conveyed;

a heater disposed in proximity to an irradiation span spanning on an inner circumferential surface of the endless belt in a circumferential direction thereof to emit light that irradiates and heats the irradiation span of the endless belt; and a shield interposed between the heater and the irradiation span of the endless belt in a diametrical direction thereof to shield the irradiation span of the endless belt from heated air surrounding the heater, wherein a thermal resistance of the shield is greater than a thermal resistance of the endless belt.

* * * * *